United States Patent [19]

Samson et al.

[11] Patent Number: 4,570,598

[45] Date of Patent: Feb. 18, 1986

[54] AIR ASSIST FUEL DISTRIBUTOR TYPE FUEL INJECTION SYSTEM

[75] Inventors: Rogelio G. Samson, Bloomfield Hills; Paul L. Koller, Wyandotte; Laszlo Hideg, deceased, late of Dearborn Heights, all of Mich., by Gizella Hideg, executrix

[73] Assignee: Ford Motor Company, Dearborn, Mich.

[21] Appl. No.: 723,604

[22] Filed: Apr. 15, 1985

[51] Int. Cl.[4] ..... F02M 61/16

[52] U.S. Cl. ..... 123/445; 123/478; 123/585; 239/428.5; 239/585

[58] Field of Search ..... 123/445, 478, 585, 587; 239/428.5, 585

[56] References Cited

U.S. PATENT DOCUMENTS

| | | | |
|---|---|---|---|
| 3,460,520 | 8/1969 | Huber | 123/478 |
| 4,224,904 | 9/1980 | Clerk | 123/445 |
| 4,351,304 | 9/1982 | Schweizer | 123/585 |
| 4,436,071 | 3/1984 | Hafner et al. | 123/472 |
| 4,465,050 | 8/1984 | Igashira et al. | 123/585 |
| 4,475,486 | 10/1984 | Kessler | 123/445 |
| 4,519,370 | 5/1985 | Iwata | 123/478 |

FOREIGN PATENT DOCUMENTS

| | | | |
|---|---|---|---|
| 1270945 | 4/1972 | United Kingdom | 123/445 |

*Primary Examiner*—William A. Cuchlinski, Jr.
*Attorney, Agent, or Firm*—Robert E. McCollum; Clifford L. Sadler

[57] ABSTRACT

A fuel injection fuel supply system for an automotive type internal combustion engine in which a single fuel injector injects all of the fuel in equal amounts to each of the engine cylinders through an atmospheric air chamber from which fuel is discharged and combined with the air for atomization of the fuel and passage of an emulsion of air and fuel into each individual engine intake port.

4 Claims, 3 Drawing Figures

AIR ASSIST FUEL DISTRIBUTOR TYPE FUEL INJECTION SYSTEM

This invention relates in general to an automotive type fuel injection system and more particularly to one in which a single fuel injector discharges fuel through a stationary fuel distributor to be mixed with air that atomizes the fuel, an air-fuel emulsion then being delivered in equal amounts to each of the engine cylinders.

A primary object of the invention is to provide a fuel injection system in which equal distribution of fuel to all of the engine cylinders is achieved using only a single fuel injector and atomization of the fuel discharged from the injector is obtained through the use of an of air assist chamber, which reduces the atomization requirements of the injector per se, and thereby facilitates the use of low cost injector designs, minimizes the general fuel pressure requirements, and reduces wall wetting, which thereby reduces the intake manifold heating requirements.

This invention is an improvement over that described in our co-pending application, U.S. Ser. No. 713,079, entitled "AIR ASSISTED FUEL DISTRIBUTED AIR-FUEL SUPPLY SYSTEM" filed Mar. 18, 1985, and having a common assignee. It shows the use of a single fuel injector with a rotating distributor to provide equal amounts of air atomized fuel to each of the engine cylinders. The present invention provides a stationary fuel distributor with discharge nozzles equal in number to the number of engine cylinders and cooperating with an air chamber and individual air-fuel supply tubes for delivering air atomized fuel in equal volumes to the engine cylinders.

Figure 1:
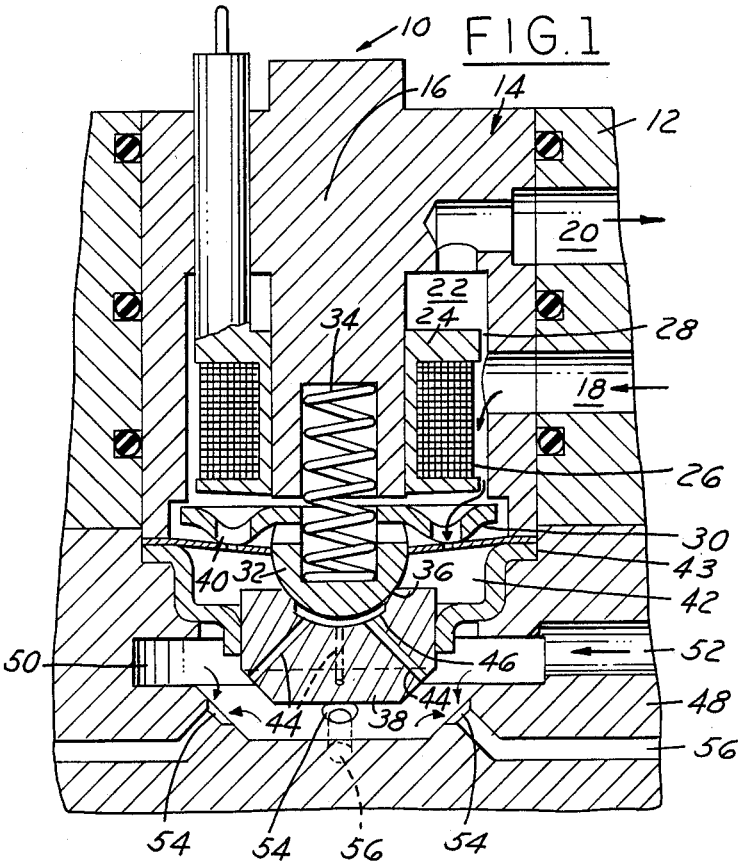
Figure 2:
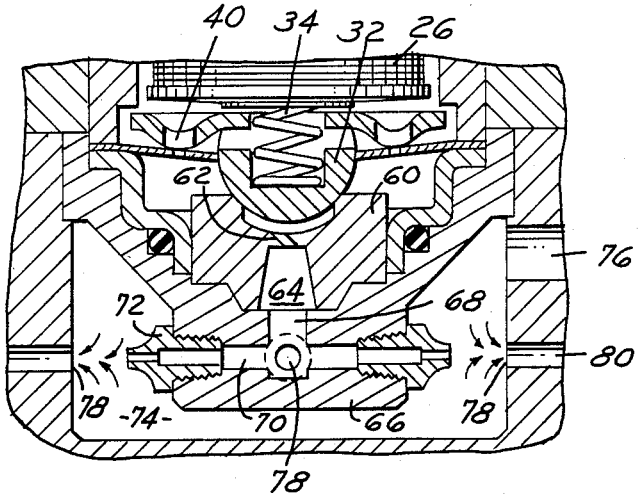
Figure 3:
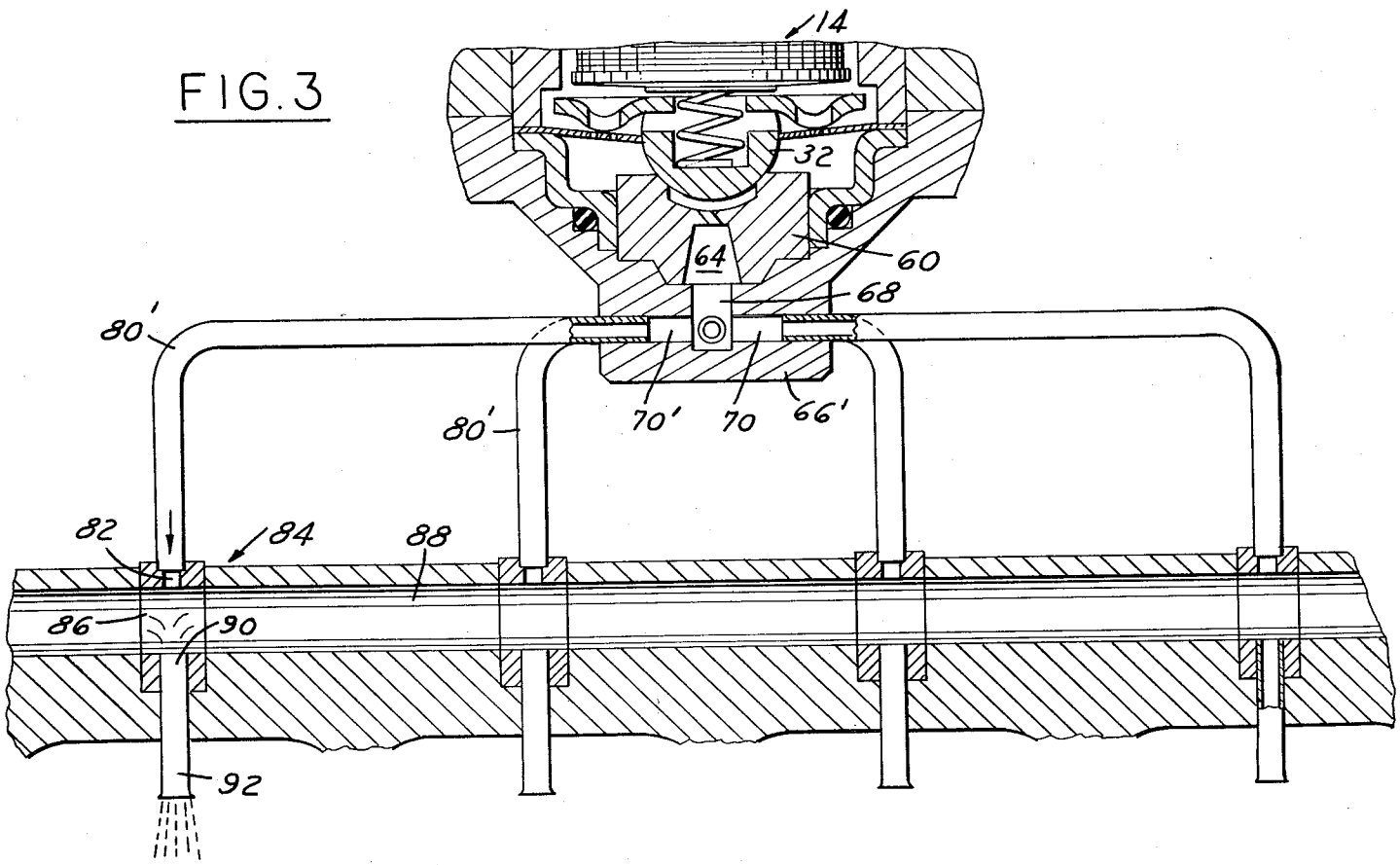

Other objects, features and advantages of the invention will become more apparent upon reference to the succeeding, detailed description thereof, and to the drawings illustrating the preferred embodiments thereof; wherein, FIG. 1 schematically illustrates a cross-sectional view of a portion of a fuel injection valve assembly embodying the invention;

FIG. 2 is a view similar to FIG. 1 illustrating a modification thereof; and FIG. 3 is a cross-sectional view of a fuel injector assembly similar to that shown in FIG. 2 illustrating a further embodiment of the invention.

As stated previously, it is a primary object of the invention to provide a fuel injection system in which fuel from a single injector is atomized by air and combined therewith for flow directly to each of the engine cylinders adjacent the intake valves, thus providing equal volumes of an air-fuel emulsion to each of the cylinders to improve the efficiency and economics of operation of the engine.

FIG. 1 illustrates schematically portions of a known type of single fuel injector assembly 10 similar to that fully shown and described in U.S. Ser. No. 4,436,071. It includes an outer support housing 12 within which is mounted a fuel injection valve 14. The valve includes a stationary core portion 16 having fuel inlet and outlet passages 18 and 20 interconnected by a chamber 22. A carrier 24 for a magnetic coil 26 separates the inlet and discharge lines by means of a controlled orifice like vapor clearance space 28. The carrier also is operatively associated with a movable armature 30. The latter is integral with a ball-type valve 32 that is biased by a spring 34 against a conical like valve seat 36 formed in an injector tip 38. The armature 30 is provided with a number of holes 40 through which fuel can flow from inlet line 18 past the outer circumference of coil 26 to a fuel collecting chamber 42.

The injector tip 38 is secured to the housing by a cup-like extension 43, by means not shown. Four circumferentially spaced fuel metering orifices 44, in this case corresponding to the number of engine cylinders, are provided in injector tip 38. They extend radially outwardly from a conical surface or recess 46 formed in the tip directly beneath the ball valve 32, and are spaced equally 90° apart. This results in the discharge of four narrow fuel jet portions with equal flow rates.

The lower portion of the injector housing 48 includes an air chamber 50 that is concentric to the injector tip 38, and into which the tip protrudes. The air chamber is supplied with air through a passage 52 at essentially atmospheric pressure from any suitable source such as, for example, the engine air cleaner. The air chamber has four outlet holes 54 corresponding in number to the number of fuel orifices and are concentric with or axially aligned with the fuel orifices.

Each of the holes 54 is connected by a passage 56 to an individual engine cylinder, and more particularly to a point adjacent its intake valve. The individual tubing or passages thereby protrude into each intake manifold runner so as to be subjected to the intake manifold vacuum therein. AS a result, the air chamber being essentially at an atmospheric pressure level and the pressure at the intake ports being subatmospheric, an air flow will always occur from the air cleaner into air chamber 50 and therefrom through the discharge holes 54 to each intake port. In air chamber 50, a strong air flow pattern therefore will exist in front of the discharge holes 54, and air from every direction will rapidly accelerate toward each discharge hole. The fuel is injected from orifices 44 directly into this accelerating air flow. The drag forces between the air and the fuel will atomize the fuel jet upon approaching the air chamber outlet 54. An emulsion of a small quantity of air and finely atomized fuel droplets therefore will travel through the fuel distribution passages 56 to each of the intake ports so long as fuel is injected. Between injections, only air will flow through the emulsion passages. The flow area of these passages will be controlled to flow approximately 50% of the air flow requirements of the engine during engine idle speed opeation. Air chamber 50 and supply passage 52 would be made large enough to insure that at the points where the fuel jets enter the air chamber, the air pressure will be and remain nearly atmospheric.

As thus far described, therefore, it will be seen that upon energization of magnetic coil 26, such as by a microprocessor or similar means not shown, armature 30 will be drawn upwardly against the force of spring 34 to separate ball valve 32 from the injector tip 38. This will allow fuel to flow from inlet line 18 past the outer periphery of coil 26 and through holes 40 into well 46 of the injector tip to be distributed equally to the four fuel orifices 44. This fuel is then ejected into air chamber 50 directly toward discharge outlets 54 to be carried along with the air flowing thereinto so as to be finely atomized and form an air-fuel emulsion for passage to the engine.

The use of a separate air chamber 50 reduces the need for providing fuel atomization in the injector design itself, and, therefore, permits a more economically designed injector. It also permits reducing the general fuel pressure requirements, higher values of which would be needed to atomize the fuel. The air assist atomization of the fuel further reduces wall wetting and thereby reduces the requirements for heating the engine intake manifold to vaporize fuel globules. This results in higher engine output power, reduced CO emissions, improved general fuel efficiency, and improved cold start properties, including driveability.

FIG. 2 shows a modified version of the construction shown in FIG. 1. FIG. 2 shows an injector tip 60 similar to that shown and described in U.S. Pat. No. 4,436,071 referred to above. The injector has one or more discharge orifices 62 that spray the fuel into a conical cavity 64 to eventually impinge on the walls of the cavity for an annular drip-type discharge from the lower edge thereof. In this case, in a manner similar to that described in connection with the showing in FIG. 1, a fuel distributor cup 66 is secured to the underside of injector tip 60 as shown. In this case, the distributor cup has a central cylindrical cavity 68 connected to cavity 64 of injector tip 60. The cavity 68, in turn, is intersected at right angles by four fuel discharge passages 70 equally spaced 90° apart. The opposite end of each passage 70 is threaded for receiving a fuel distributor orifice 72, the orifices being of a size providing a pressure drop during injection that is substantially smaller than the injection pressure itself. The uniformity of cylinder-to-cylinder fuel distribution depends upon the uniformity of the distributor orifices. The advantage of the orifices being threadedly connected to passages 70 is that, in production, matched sets can be installed in each distributor cup 66.

As in connection with the FIG. 1 construction, the fuel distributor cup 66 of FIG. 2 also has a concentrically mounted atmospheric air chamber 74 connected to an atmospheric air supply line 76. Four outlet holes 78 are connected by suitable passages 80 individually to each of the engine cylinder intake ports. Again, the outlets 78 are concentric or axially aligned with the axis of the fuel orifices 72 for a direct spray of fuel through the air chamber into the outlets. The fuel is thus finely atomized by the air and mixed with the air for an emulsion of air and fuel passing into passages 80 to each of the engine cylinder intake ports. The air-fuel emulsion, of course, will tend to gravitate towards that discharge hole and passage where the pressure differential is greatest due to the opening of that particular intake port at that particular time. This action, however, occurs during every cycle of the engine, and, therefore, an equal distribution of fuel is provided to each cylinder. Because the air chamber is at an atmospheric pressure level, and because the individual intake runners are always at least at some average subatmospheric or vacuum level, the air-fuel flow will occur at all engine operations even when the intake manifold vacuum is very low, such as during full throttle, high load operation.

FIG. 3 shows a further embodiment of the invention similar in many respects to the embodiment described in connection with FIG. 2. Again, an essentially conventional fuel injector assembly 14 is provided having a ball-type valve 32 alternately seated or unseated from an injector tip 60. Again, a sealed fuel distributor cup 66' is secured to the bottom of the injector tip 60 and provided with four discharge passages 70 emanating at right angles from a central cavity 68 directly beneath the injector tip cavity 64.

In this case, fuel orifices 82 are provided at the ends of the individual air-fuel passages 80' which in this case are connected directly to each individual engine intake port through an individual fuel atomizer 84. Fuel distribution orifices 82 are located at the top of each atomizer and inject fuel into and through a large diameter horizontally disposed atmospheric air hole 86 of the atomizer. The air holes of the atomizers are connected to the air cleaner by an atmospheric air passage 88 in the cylinder head or through the intake manifold. At the bottom of each atomizer 84 is an emulsion outlet hole 90 that is concentrically located and directly aligned with the discharge orifice 82 in the same manner as in the construction shown in FIGS. 1 and 2 to receive the fuel and air therein. The atomized fuel combines with the air to provide an emulsion of air and fuel for passage through tubes 92 directly through the engine intake port into the engine combustion chamber.

From the foregoing, therefore, it will be seen that the invention provides a fuel injection system in which fuel is injected into each individual engine intake port from a single fuel injector that cooperates with an atmospheric air chamber to atomize the fuel as well as combine air with the fuel to provide an emulsion that passes to each of the individual intake ports, this being accomplished by means of a distributor arrangement that provides an equal amount of fuel to each of the engine cylinders.

While the invention has been shown and described in its preferred embodiments, it will be clear to those skilled in the arts to which it pertains that many changes and modifications may be made thereto without departing from the scope of the invention.

We claim:

1. A fuel supply system for an internal combustion engine comprising a single fuel injector supplying fuel to a plurality of cylinders of the engine, each cylinder having an intake port at one end of an individual fuel line connected thereto for the flow of fuel thereinto, the opposite end of each fuel line being operatively connected to the fuel injector, the injector having a tip having a number of fuel discharge passages corresponding in number to the number of fuel lines and an atmospheric air chamber contiguous to the passages, means connecting each fuel line to a fuel passage across the air chamber with an air space therebetween for atomization of the fuel discharged between the two in response to vacuum in the engine intake ports establishing an air flow through the air chamber and fuel lines carrying the atomized fuel therewith for an equal distribution to each cylinder.

2. A fuel supply system as in claim 1, wherein the fuel lines and fuel passage of each pair are concentrically mounted and axially spaced from one another.

3. A fuel supply system as in claims 1 or 2, wherein the tip of the injector is formed with a number of circumferentially spaced radially disposed discharge passages, the air chamber surrounding the injector tip.

4. A fuel supply system as in claim 1, including a fuel distributor secured to the tip of the fuel injector for flow of fuel thereinto, the distributor having the fuel passages therein for passage of the fuel into the fuel lines, the air chamber surrounding the distributor.

* * * * *